United States Patent [19]

Willim

[11] Patent Number: 4,580,615

[45] Date of Patent: Apr. 8, 1986

[54] APPARATUS FOR CLOSING THE SIDES OF A SUBSTANTIALLY RECTANGULAR MOLD CHAMBER IN A CONTINUOUS CASTING INSTALLATION

[75] Inventor: Fritz Willim, Birmensdorf, Switzerland

[73] Assignee: Concast Service Union AG, Zürich, Switzerland

[21] Appl. No.: 715,972

[22] Filed: Mar. 25, 1985

[30] Foreign Application Priority Data

Apr. 18, 1984 [CH] Switzerland ..... 1942/84

[51] Int. Cl.[4] ..... B22D 11/06

[52] U.S. Cl. ..... 164/428; 164/480

[58] Field of Search ..... 164/479–482, 164/427–429, 431–434, 488, 490, 437, 439, 440

[56] References Cited

U.S. PATENT DOCUMENTS 3,501,561 3/1970 Oxley et al. ..... 164/428 X

*Primary Examiner*—Kuang Y. Lin

*Attorney, Agent, or Firm*—Werner W. Kleeman

[57] ABSTRACT

In a method for the continuous casting of metal, in particular steel in the form of strips or thin slabs, the molten metal is poured into a mold chamber having two arcuate cooled broad or wide side walls which rotate in a predetermined direction of casting in which the cast metal strand moves and two stationary cooled narrow side walls. To prevent defects in the strand and interruption of the casting operation, the narrow side walls of the mold chamber are thermally insulated in a first portion as seen in the predetermined direction of casting. In a second portion, the narrow side walls have high thermal conductivity over the entire distance between the broad side walls. This second portion is disposed in a substantially parallel part of the mold chamber between the broad side walls.

10 Claims, 5 Drawing Figures

APPARATUS FOR CLOSING THE SIDES OF A SUBSTANTIALLY RECTANGULAR MOLD CHAMBER IN A CONTINUOUS CASTING INSTALLATION

CROSS REFERENCE TO A RELATED APPLICATION

This application is related to my co-pending, commonly assigned U.S. patent application Ser. No. 06,715,987, filed Mar. 25, 1985, and entitled "Method of, and Apparatus for, Continuously Casting Metal in a Mold Chamber Having Cooled Rotating Walls"

BACKGROUND OF THE INVENTION

The present invention broadly relates to continuous casting and, more specifically, pertains to a new and improved apparatus for closing or obturating the sides of a mold chamber of substantially rectangular cross-section in a continuous casting installation.

Generally speaking, the apparatus of the present invention obturates the sides of a mold chamber which comprises two arcuate cooled broad or wide side walls rotating in the direction of casting or the direction in which the cast strand moves and two stationary cooled narrow side walls. The two stationary cooled narrow side walls engage between the two arcuate cooled broad side walls.

In the continuous casting of metals, in particular of steel, in the form of thin broad strips, high casting rates are necessary to achieve the production capacities required in large-scale industrial operations. Furthermore, considerable difficulties arise in achieving uniformity in the feeding of the molten metal into a broad, thin, oscillating, open-ended mold in which the metal solidifies at least at its surface. To solve these problems, continuous casting installations have been developed in which the molten metal is brought between two cooled rotating drums or moving strips, or a combination of both, and is allowed to solidify while in contact with the cooled walls of these elements. In such installations, the cooled walls, which form the narrow sides of the mold chamber, may be moved in synchronism with the drums or strips or be kept stationary.

German Patent Publication No. 2,063,591, published July 15, 1971, discloses a strip-casting machine comprising two drums which rotate in the direction in which the cast strand is moved. The two arcuate and cooled surfaces of the drums form broad side walls of the mold chamber, while two stationary cooled walls constitute the narrow side walls of the mold chamber. These narrow side walls engage to some extent within the two arcuate broad side walls. In the direction in which the strand moves, the engaging portions of the narrow side walls are directly adjacent a metal feed device and can be electrically heated. In this continuous casting installation, solidification at the narrow sides of a strip or thin slab is delayed over part of the thickness of the strand, which can result in metal breakouts downstream of the narrowest gap between the two drums or at the outlet of the mold chamber. Furthermore, solidified portions of the strand crust or shell can become jammed between the engaging portion of the narrow side wall and the mold chamber which narrows in the direction of movement of the strand, and these portions of strand crust or shell can tear open an already solidified thin strand crust at the broad sides of the strand and lead to defective strands or even metal breakouts.

SUMMARY OF THE INVENTION

Therefore, with the foregoing in mind, it is a primary object of the present invention to provide a new and improved construction of an apparatus for obturating the sides of a substantially rectangular mold chamber in a continuous casting installation which does not exhibit the aforementioned drawbacks and shortcomings of the prior art constructions.

Another and more specific object of the present invention is to form the narrow sides of a mold chamber in a continuous casting installation in such a way that the above mentioned disadvantages are eliminated. In particular, the invention seeks to control the solidification of the narrow side of the cast strand in such a way that, on the one hand, defect-free strands are produced, and, on the other hand, wear of those parts of the installation that form the mold chamber can be considerably reduced.

A further object of the invention is to enable thin and thick strips or thin slabs of differing widths to be produced on one and the same installation of high production capacity, while having to exchange a minimum number of components.

Yet a further significant object of the present invention aims at providing a new and improved construction of an apparatus of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the apparatus of the present invention is manifested by the features that the two arcuate cooled broad side walls and the two stationary cooled narrow side walls conjointly define a mold chamber, the two stationary cooled narrow side walls are thermally insulated in a first portion thereof as seen in the predetermined direction of casting, the two stationary narrow side walls have a high thermal conductivity in a second portion thereof across the entire distance or spacing between the two arcuate cooled broad side walls, and this second portion is disposed in a substantially parallel part of the mold chamber between the two arcuate cooled broad side walls.

By means of the apparatus constructed in accordance with the invention, it is possible to control solidification of the narrow sides of the cast strand and to cast, in addition to thin steel strips, strips having a thickness of approximately 20–50 mm, or thin slabs, at a high rate of production. The inventive apparatus also permits the production of defect-free strands having perfect surfaces at the narrow and broad sides. Furthermore, the number of metal breakouts and the wear on the drums and narrow side walls can be considerably reduced by the solution offered by the invention. A further advantage resides in the fact that, since fewer parts such as feed means and narrow side walls need to be exchanged, strips of various thicknesses and thin slabs of different widths can readily be cast in one and the same installation.

In the casting of thick strips or thin slabs, the danger of metal breakouts at the narrow side increases with casting capacity. In accordance with a further feature of the invention, it is proposed to lengthen the narrow side walls in the direction in which the strand moves and along the narrowest gap between the broad side walls and to widen the narrow side walls again downstream of the narrowest gap between the broad side walls. This results in the cooling and support of the strand being formed over a longer distance, and prevention of metal breakouts is thus enhanced. The mold chamber may be substantially parallel between the narrow sides in the first heat insulated portion and may converge in the direction of casting in the second and subsequent portion.

The quality of the surface of the cast strand can be further improved on the narrow sides if the narrow side walls are thermally insulated over part of the length of the mold chamber and across the entire gap or spacing between the broad side walls, and if the narrow side walls are in one plane. Jamming and wear can thus be reduced or prevented.

Depending upon the required thickness of the strip or strand and upon the envisaged displaceability of the narrow side walls, cooling water ducts can be formed in the narrow sides.

In accordance with a further feature of the invention, the mold chamber can be sealed off or obturated by controlling local solidification if the narrow side walls are thermally insulated from the mold chamber in the direction of movement of the strand and immediately adjacent the end of the metal feed means, by a median portion of the gap or spacing between the broad side walls, and if the narrow side walls have high thermal conductivity at the two end portions adjoining the broad side walls.

The narrow side walls may laterally adjoin the metal feed means. In this construction, adjustment of the width of the strand can be carried out only when the installation is at a standstill. The metal feed means has to be replaced by one that is suited to the new width of strip. If, while the casting operation is proceeding, it is required to adjust the width of the strand, then in accordance with a further inventive feature, at least one narrow side wall adjoins the metal feed means as seen in the direction of movement of the strand and is adapted to be displaced transversely of this direction of movement.

In the case of metals having high fluidity, molten metal may penetrate into the interface zones or interstices between the drums and the metal feed means as well as the narrow side walls within the mold chamber and may lead to interference with the casting operation or to surface defects on the cast strand. To eliminate such disadvantages, it is proposed in this form of construction to form the narrow side wall, upstream of the heat insulated portion in a narrow zone immediately adjacent the metal feed means, and across the entire thickness at the gap of cooled material having high thermal conductivity. The crust, initially solidified there, becomes remelted in that zone of the heat insulated part or portion that is remote from the cooled broad sides and only reforms in the cooled part of the narrow side wall. Jamming of the strand is thus prevented.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
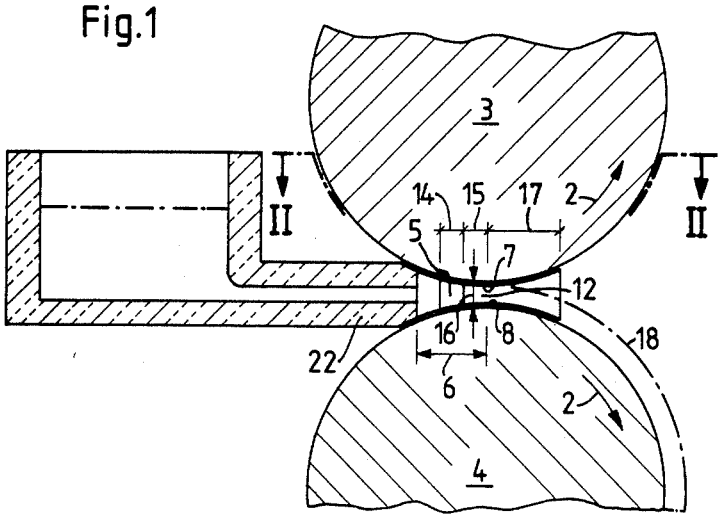
FIG. 1 schematically shows a vertical section through part of a diagrammatically illustrated strip-casting installation, taken along line I—I of FIG. 2.
Figure 2:
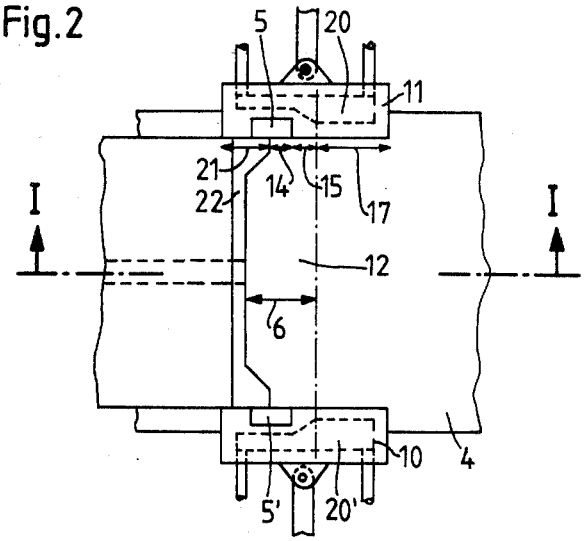
FIG. 2 schematically shows a section taken along the line II—II of FIG. 1.

Describing now the drawings, it is to be understood that to simplify the showing thereof only enough of the structure of the apparatus for obturating the sides of a mold chamber has been illustrated therein as is needed to enable one skilled in the art to readily understand the underlying principles and concepts of this invention. Turning now specifically to FIGS. 1 and 2 of the drawings, the apparatus illustrated therein by way of example and not limitation will be seen to comprise a continuous casting installation for strips and thin slabs which comprises two cooled casting drums 3 and 4 which rotate in the casting direction or the direction 2 in which the strand moves. Over the distance indicated by the arrows 6, the cooled casting drums 3 and 4 form two arcuate cooled broad or wide side walls 7 and 8, and together with two stationary cooled narrow side walls 10 and 11 they enclose and define a mold chamber 12. The two stationary cooled narrow side walls 10 and 11 close off or obturate the mold chamber 12 at the sides, the mold chamber 12 having a substantially rectangular cross-section for casting rectangular strands. At least parts of the two stationary cooled narrow side walls engage between the two arcuate cooled broad side walls 7 and 8, i.e. between the surfaces of the cooled casting drums 3 and 4.

In a first portion or zone 14, as seen in the direction 2 of movement of the strand, the two stationary cooled narrow side walls 10 and 11 are thermally insulated along the mold chamber 12, e.g. by means of refractory elements 5 and 5', which are sunk or embedded into the two stationary cooled narrow side walls 10 and 11, respectively. The refractory resistance, thermal conductivity and material can be selected in relation to the metal being cast, casting capacity et cetera. Advantageously, use is made of known refractory materials which do not become wetted by molten material. In the first portion or zone 14, the two stationary cooled narrow sides 10 and 11 are thermally insulated over the entire distance or spacing between the two arcuate cooled broad side walls 7 and 8.

In a second portion or zone 15, the two stationary cooled narrow side walls 10 and 11 possess high thermal conductivity over the entire distance or spacing 16 between the two arcuate cooled broad side walls 7 and 8. They are generally made of metal, in particular of copper, and are cooled with water or other suitable cooling medium. The second portion or zone 15 constitutes the last part or region of the mold chamber 12. It tapers very slightly in the direction 2 in which the strand moves, and is therefore approximately parallel-sided between the two arcuate cooled broad side walls 7 and 8. The length of this second portion or zone 15 has a very considerable influence upon the formation of crust or shell on the narrow sides of the strip or strand being cast. If, at high production capacities and at the resultant high casting rates, long portions or zones 15 are required for extraction of heat, the drum diameters must be correspondingly greater. The two stationary cooled narrow side walls 10 and 11 are advantageously arranged to converge in the direction 2 in which the strand moves to accommodate shrinkage.

The two stationary cooled narrow side walls 10 and 11 are lengthened in a part or zone 17 projecting beyond the mold chamber 12. Downstream of the narrowest gap or spacing between the cooled casting drums 3 and 4, these two stationary cooled narrow side walls 10 and 11 widen again and can thus further cool and support the strand, as indicated by the dash-dot line 18.

The two stationary cooled narrow side walls 10 and 11 comprise cooling ducts 20 and 20', which may be disposed entirely or partly outside the rotating surfaces of the cooled casting drums 3 and 4. The two stationary cooled narrow side walls 10 and 11 laterally adjoin the metal feed means 22 with a portion 21.

Figure 3:
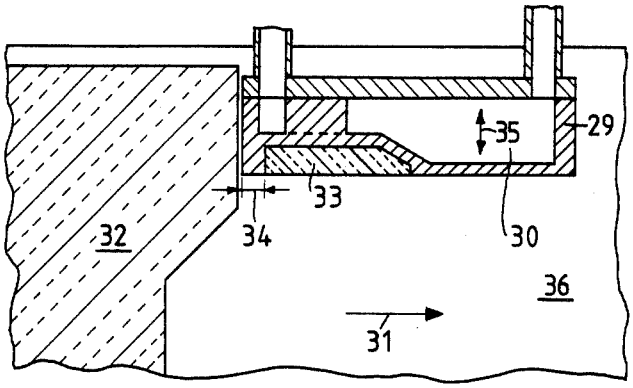
FIG. 3 schematically shows a section through the mold chamber in a further embodiment.

As shown in FIG. 3 and as seen in the direction 31 in which the strand moves, a narrow side wall 29 adjoins the metal feed means 32. This narrow side wall 29 is displaceably arranged transversely of the direction 31 in which the strand moves, as indicated by the arrows 35, and it can also be moved during the casting operation for altering the width of the strip. In such narrow side walls 29, cooling water ducts 30 are arranged entirely within that cross-section of the narrow side wall 29 that engages between the rotating broad side walls 36.

In the case of this narrow side wall 29, a narrow zone 34 of cooled material having high thermal conductivity is provided upstream of the heat insulated part 33 and immediately adjacent the metal feed means 32 extending across the entire thickness of the material forming the gap.

Figure 4:
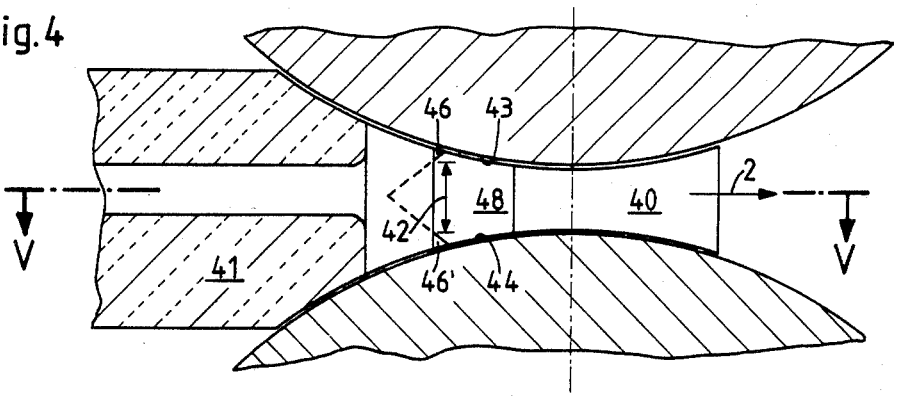
FIG. 4 schematically shows a vertical section through a mold chamber in a still further embodiment.
Figure 5:
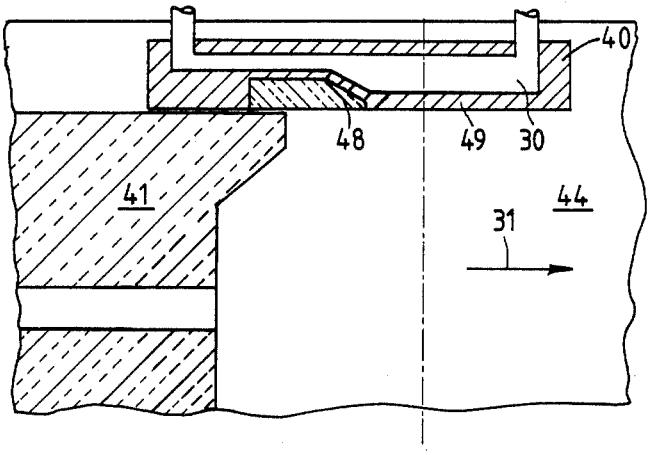
FIG. 5 schematically shows a section taken along the line V—V of FIG. 4.

FIGS. 4 and 5 illustrate a slightly modified embodiment of narrow side wall 40. A metal feed means 41 is of substantially the same form as that shown in FIG. 2. As seen in the direction of movement of the strand, the narrow side wall 40 is thermally insulated immediately at the end of the metal feed means 41 over a median part, represented by arrows 42, of the distance or spacing between the rotating broad side walls 43 and 44. Both of the end parts 46 and 46' adjoining the rotating broad side walls 43 and 44 have high thermal conductivity. As shown in this example, a refractory block or element 48, sunk or imbedded into the narrow side wall 40, can be pentagonal in section. The molten metal becomes solidified when in contact with the cooled end parts 46 and 46'. This reduces the risk of the metal penetrating into the gap or interstice between the narrow side wall 40 and the rotating broad side walls 43 and 44. The refractory block 48 prevents premature and excessive solidification of the narrow sides 40 of the strand and therefore prevents it from jamming in the mold chamber. Following the refractory block 48 is a portion or zone 49 effecting considerable cooling, as described in connection with the embodiments described earlier.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for obturating the sides of a mold chamber of substantially rectangular cross-section in a continuous casting installation having a predetermined direction of casting, comprising:

two arcuate cooled broad side walls rotating in the predetermined direction of casting;

two stationary cooled narrow side walls;

said two stationary narrow side walls engaging between said two arcuate cooled broad side walls;

said two arcuate cooled broad side walls and said two stationary narrow side walls conjointly defining a mold chamber having a substantially parallel region;

said two stationary narrow side walls being thermally insulated in a first portion thereof as seen in the predetermined direction of casting;

said two stationary narrow side walls having a high thermal conductivity in a second portion thereof across the entire distance between said two arcuate cooled broad side walls; and said second portion being disposed in said substantially parallel region of said mold chamber between said two arcuate cooled broad side walls.

2. The apparatus as defined in claim 1 wherein:

said two stationary narrow side walls project beyond a narrowest gap between said two arcuate cooled broad side walls in the predetermined direction of casting.

3. The apparatus as defined in claim 1 wherein:

at least one rotating broad side wall of said two arcuate cooled broad side walls is formed as a drum; and said two stationary narrow side walls widening downstream of said narrowest gap between said two arcuate cooled broad side walls.

4. The apparatus as defined in claim 1, wherein:

said two stationary narrow side walls are thermally insulated in a first portion of their length across the entire distance between said two arcuate cooled broad side walls.

5. The apparatus as defined in claim 1 further including:

a metal feed means; and said two stationary narrow side walls laterally adjoining said metal feed means.

6. The apparatus as defined in claim 1 wherein:

said two stationary narrow side walls engage between said two rotating arcuate cooled broad side walls; and cooling water ducts of said two stationary narrow side walls being mainly arranged outside said two rotating arcuate cooled broad side walls.

7. The apparatus as defined in claim 6 wherein:

said two stationary narrow side walls engage between said two rotating arcuate cooled broad side walls;

said two stationary narrow side walls being displaceable between said two rotating arcuate cooled broad side walls and transversely of the predetermined direction of casting; and said cooling water ducts being arranged entirely within a cross-section of said narrow side wall engaging between said two rotating arcuate cooled broad side walls.

8. The apparatus as defined in claim 5 wherein:

said two stationary narrow side walls as seen in the predetermined direction of casting are thermally insulated directly at the end of said metal feed means and across a median portion of the distance between said two rotating arcuate cooled broad side walls; and said two stationary narrow side walls having high thermal conductivity at two end parts thereof adjoining said two rotating arcuate cooled broad side walls.

9. The apparatus as defined in claim 5 wherein:

said two stationary narrow side walls, as seen in the predetermined direction of casting, adjoin said metal feed means and are adapted to be displaced transversely of the predetermined direction of casting.

10. The apparatus as defined in claim 9 wherein:

upstream of said thermally insulated portion and in a narrow zone immediately adjacent said metal feed means, said two stationary narrow side walls comprise material of high thermal conductivity over the entire thickness at a gap between said two arcuate cooled broad side walls.

* * * * *